US012599165B2

(12) United States Patent
Wong

(10) Patent No.: US 12,599,165 B2
(45) Date of Patent: Apr. 14, 2026

(54) TRAY LOADING AND UNLOADING SYSTEM

(71) Applicant: Charles Wong, Pasadena, CA (US)

(72) Inventor: Charles Wong, Pasadena, CA (US)

( * ) Notice: Subject to any disclaimer, the term of this patent is extended or adjusted under 35 U.S.C. 154(b) by 506 days.

(21) Appl. No.: 18/313,934

(22) Filed: May 8, 2023

(65) Prior Publication Data

US 2024/0306699 A1 Sep. 19, 2024

Related U.S. Application Data

(63) Continuation-in-part of application No. 18/183,031, filed on Mar. 13, 2023, now Pat. No. 12,490,763.

(51) Int. Cl.

| | |
|---|---|
| ***A24C 5/01*** | (2020.01) |
| ***A24C 5/00*** | (2020.01) |
| ***B65B 1/02*** | (2006.01) |
| ***B65B 1/06*** | (2006.01) |
| ***B65B 7/28*** | (2006.01) |

(52) U.S. Cl.

CPC ..... *A24C 5/01* (2020.01); *A24C 5/002* (2013.01); *A24C 5/005* (2013.01); *B65B 1/02* (2013.01); *B65B 1/06* (2013.01); *B65B 7/28* (2013.01)

(58) Field of Classification Search

CPC ..... A24C 5/002; A24C 5/01; A24C 5/02

See application file for complete search history.

(56) References Cited

FOREIGN PATENT DOCUMENTS

WO WO 2019140237 A1 * 7/2019 ..... A24C 5/02

* cited by examiner

*Primary Examiner* — Michael H. Wilson
*Assistant Examiner* — Ronnie Kirby Jordan
(74) *Attorney, Agent, or Firm* — Clement Cheng

(57) ABSTRACT

A tray loading and unloading system has a first station with a tray mounted to a tray retainer. The tray retainer is mounted to a tray carriage. The tray carriage slides on a tray retainer rail between a tray retracted position and a tray extended position. The tray starts as an empty tray at the tray retracted position and travels to the tray extended position to receive product tubes at the tray extended position. The tray extended position has a first pushing tamper that pushes product tubes from a first loading cup into the tray. A first loading arm loads product tubes from a first loading tube into the first loading cup.

9 Claims, 4 Drawing Sheets

TRAY LOADING AND UNLOADING SYSTEM

The present invention claims priority as a continuation in part of pending U.S. utility patent application Ser. No. 18/183,031 entitled Plant Material Loader by same inventor Charles Wong, having a filing date of Mar. 13, 2023, the disclosure of which is incorporated herein by reference.

TECHNICAL FIELD

The present invention relates to a tray loading system.

BACKGROUND a variety of different tray loading systems can handle tubular objects. However, for particular types of product tubes, the tray loading system must incorporate different handling assemblies.

DISCUSSION OF RELATED ART

A variety of different product tubes have been built using continuous feed technology such as for tobacco products.

SUMMARY OF THE INVENTION

The present invention loads and unloads product tubes such as paper tubes onto a tray having openings for receiving the product tubes. The product tubes have a mesh insert pressed into a lower portion of the product tubes.

A tray loading and unloading system has a first station with a tray mounted to a tray retainer. The tray retainer is mounted to a tray carriage. The tray carriage slides on a tray retainer rail between a tray retracted position and a tray extended position. The tray starts as an empty tray at the tray retracted position and travels to the tray extended position to receive product tubes at the tray extended position. The tray extended position has a first pushing tamper that pushes product tubes from a first loading cup into the tray. A first loading arm loads product tubes from a first loading tube into the first loading cup The second station has a suction punch that punches a mesh roll at a first die slot. The first die slot receives a first punch array of a suction punch. The first punch array is connected to a first suction array. The first suction array is connected to a flexible hose. The first punch array is configured to punch and suction a mesh disk from the mesh roll.

A flaring tool is included at the first station which reciprocates upwardly and downwardly to press on open ends of the product tubes while ensuring a circular form of the product tubes. At a tray extended position, a first pushing tamper pushes product tubes from a first loading cup into the tray. A first loading arm loads product tubes from a first loading tube into the first loading cup.

The suction punch of the second station further includes a second punch array. The third station loads plant material into the product tubes. A fourth station that covers the product tube ends with a seal. A fifth station packs the product tube into a dense pack for transfer to packaging.

Figure 1:
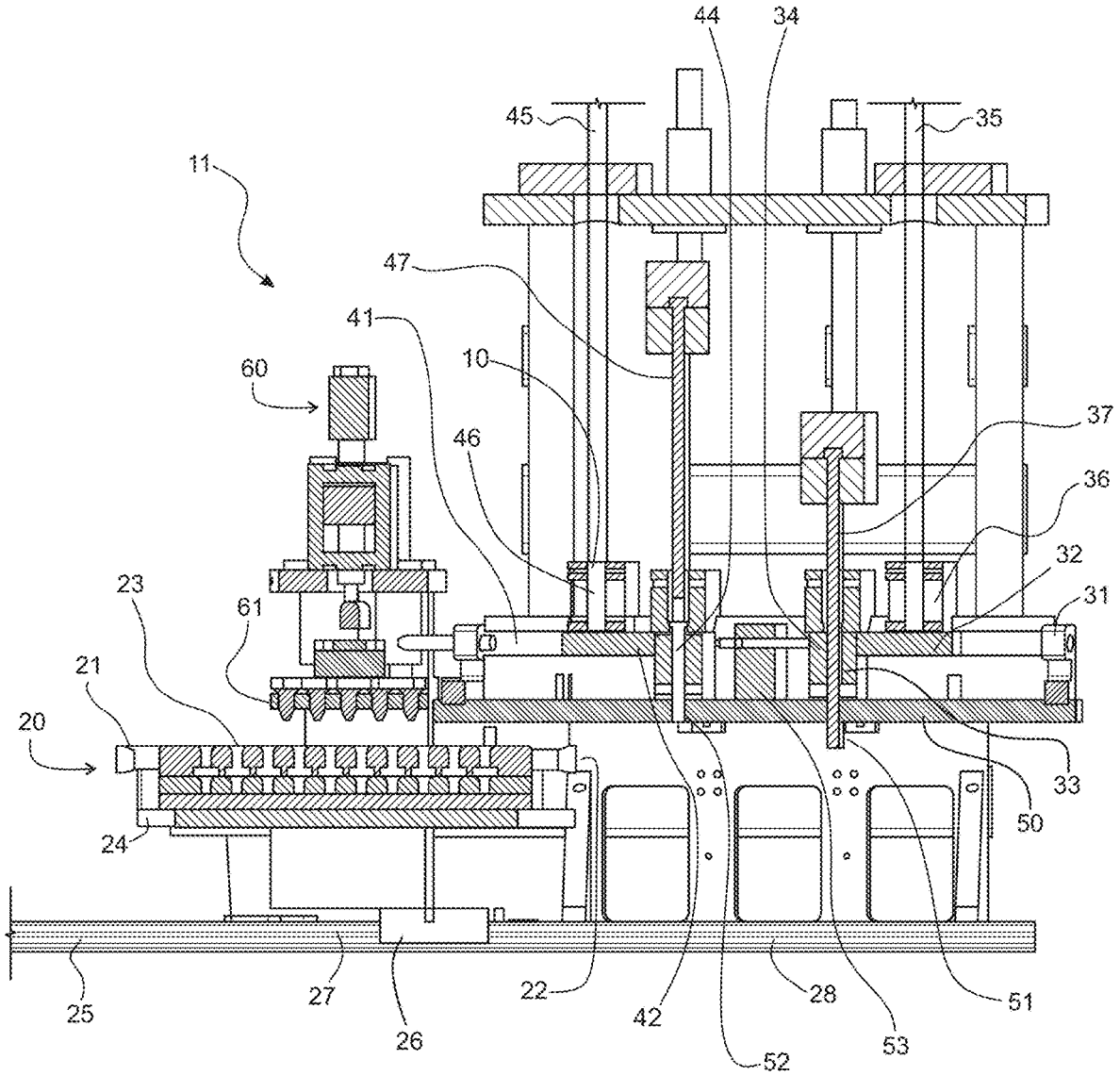
FIG. 1 is a schematic side view diagram of the first station of a tray loading system.
Figure 2:
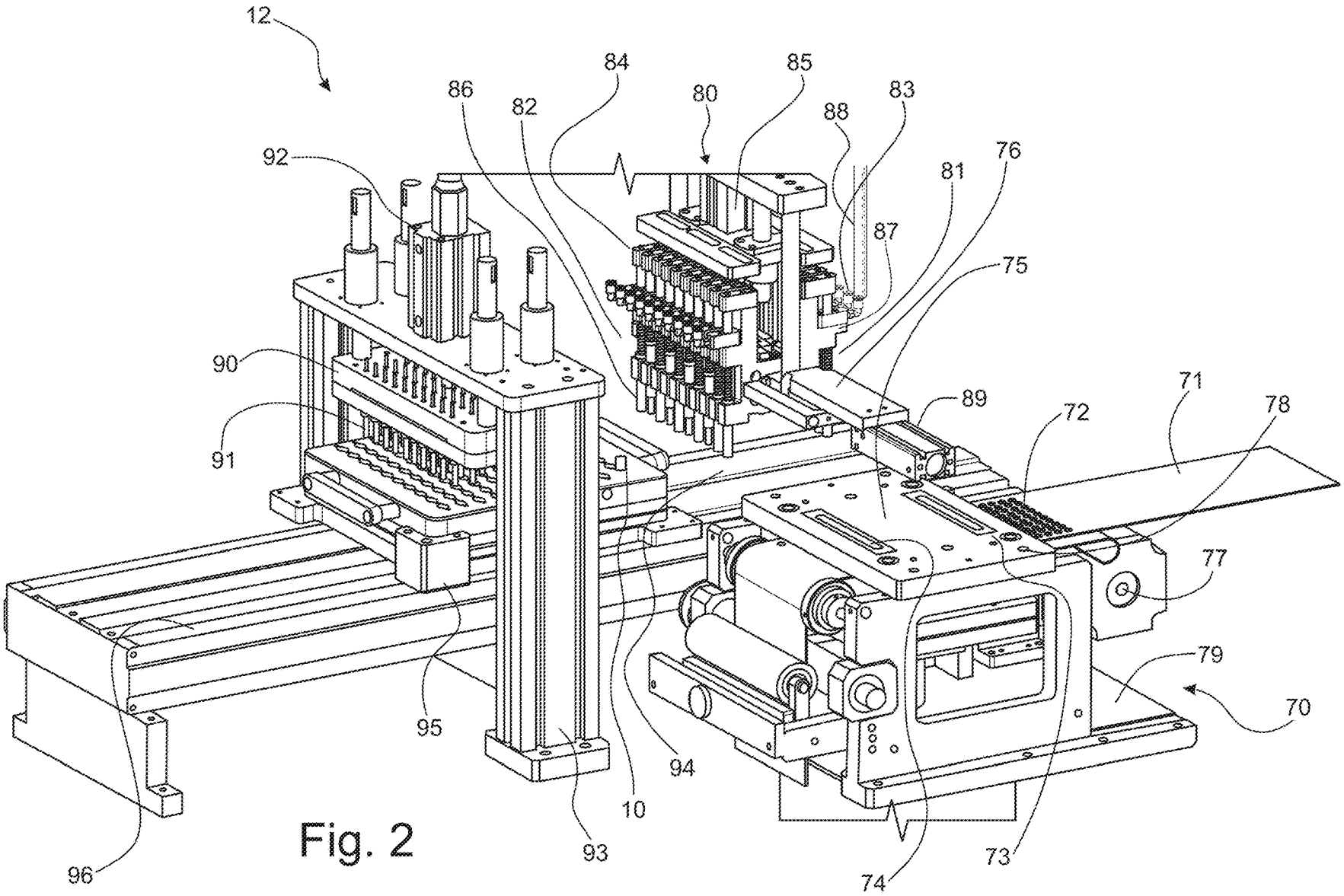
FIG. 2 is a perspective view of the second station of the tray loading system showing the mesh punch.

The following call out list of elements can be a useful guide in referencing the element numbers of the drawings.

10 Product Tube
11 First Station
20 Tray
21 First Tray Handle
22 Second Tray Handle
25 Tray Retainer Rail
23 Tray Apertures
24 Tray Retainer
26 Tray Carriage
27 Tray Retracted Position
28 Tray Extended Position
31 First Loading Arm
32 First Loading Block
33 First Loading Cup
34 First Loading Opening
35 First Loading Conduit
36 First Dropper
37 First Pushing Tamper
41 Second Loading Arm
42 Second Loading Block
43 Second Loading Cup
44 Second Loading Opening
45 Second Loading Conduit
46 Second Dropper
47 Second Pushing Tamper
50 Slide Plate
51 First Slide Plate Opening
52 Second Slide Plate Opening
53 Slide Plate Guide
60 Flaking Tool
12 Second Station
70 Roll Dispenser
71 Mesh Roll
72 Punched Holes
73 First Die Slot
74 Second Die Shot
75 Roll Punch Position
76 Press Position
77 Roller
78 Roll Die Plate
79 Roll Dispenser Frame
80 Second Section Array
81 First Punch Array
82 Second Punch Array
83 First Suction Array
85 Vertical Punch Rail Guide
86 Hollow Tube Punch
87 Air Passage
88 Flexible Hose
89 Horizontal Suction Punch Rail
90 Secondary Press Mechanism
91 Adjustable Height Rods
92 Secondary Press Motor
93 Secondary Press Rails
94 Tray Loading Position
95 Tray Press Position
96 Tray Transfer Position

13 Third Station
97 Hopper
98 Measuring Tray
99 Transfer Tamper
100 Loading Tamper
130 Receiving Tray
14 Fourth Station
101 Retaining Fingers
102 Dense Pack
110 Ejection Mechanism
111 Ejection Blades
112 Tray Slots
113 Ejection Rails
114 Picker Rail Stops
115 Press Picker
116 Tube Batch Transfer Container
117 First Transfer Handle
118 Second Transfer Handle
119 Picker Rail
120 Press Picker Receiving Face
121 Transfer Container Base
122 Transfer Sidewalls
123 Transfer Alignment Pin
124 Transfer Table
130 Paper Layer
131 Laser Cutter
132 Laser Beam
133 Paper Cover
134 Plant Material
135 Tube Sidewall
136 Baffle Filter
137 Mesh Disk

DETAILED DESCRIPTION OF THE EMBODIMENTS

As seen in the first figure, the first station 11 has a first loading conduit 35 and a second loading conduit 45. The first loading conduit 35 and the second loading conduit 45 bold a stack of tubes that form the product tubes. The tubes can be made as paper tubes for electronic vaporizer cartridges. The tubes preferably have an orientation and are oriented with their heavier side down or lighter side down. The paper tubes can be fed through a vibration table for self-orientation. The vibration table that feeds the loading tubes can be melted above the first loading conduit 35 and the second loading conduit 45. Preferably, a means for loading the vibration table can be provided such as a ladder structure to allow manual input, or by the conveyor belt or the like.

The first loading conduit 35 is connected to a first dropper 36, and the second loading tube is connected to the second dropper 46. The first dropper 36 and the second dropper 46 are mounted to allow sliding on blocks. The first dropper 36 slides on a first loading block 32. The second dropper 46 is mounted on a second loading block 42. The first loading block 32 is operatively connected to a first loading cup. The first loading arm 31 receives a tube and transfers it to the first loading cup 33. The first dropper 36 is open at its upper end and at its lower end. The first loading block 32 holds the lower end of the first dropper closed until the first loading block slides away to reveal the first loading cup 33. The first loading cup 33 is connected to and moves with the first loading block 32.

The first loading cup and the first loading block can be connected or integrally formed from a solid piece of aluminum. The first dropper 36 and the second dropper 46 can be formed as pneumatically operated clamping portions with a clamped mode and a released mode such that the pair of droppers simultaneously or in reciprocation drop the tubes one at a time into the first loading opening 34 of the first loading cup 33 and the second loading opening 44 of the second loading cup 43.

The first pushing tamper 37 reciprocates upwardly and downwardly to push the two from the first loading opening 34 and the second loading opening 44 into the tray apertures such that the tubes are retained in the tray apertures 23. A user can load the tray 20 to the tray retainer 24. The user can transport the tray by a first tray handle 21 and a second tray handle 22. Alternatively, the tray 20 can be transported via a conveyor system such as a conveyor belt. The tray retainer 24 is mounted on a tray carriage 26. The tray carriage 26 slides on a tray retainer rail 25. The tray retainer rail 25 allows the tray carriage to slide from a tray retracted position 27 to a tray extended position 28. The tray extended position 28 is underneath the first loading opening 34 and the second loading opening 44. The tray apertures 23 aligned to the first loading opening 34 and the second loading opening 44 in successive steps. The tray carriage 26 moves in steps. When 10 rows of tray apertures 23 are provided, the tray carriage 26 moves in five steps such that with each step, two rows of tray apertures are filled with tubes.

The first loading arm 31 and the second loading arm 41 are synchronized in motion with the motion of the tray carriage 26 on the tray retainer rail 25. The first loading cup 33 and the second loading cup 43 can glide on the slide plate 50. The slide plate 50 may further include a slide plate guide 53 that receives the first loading arm 31 and the second loading arm 41, thereby providing a high accuracy and precision tolerance. The first loading conduit 35 and the second loading conduit 45 can be formed as multiple hoses or rows of pipes such that they each retain numerous tubes. The first loading conduit 35 and the second loading conduit 45 can be arranged in rows. The first loading cup 33 and the second loading cup 43 can also be provided in multiples and arranged in rows. The first dropper 36 and the second dropper 46 can also be provided in multiples and arranged in rows. When the apparatus is provided in multiples and arranged in rows, the multiples should be consistent with the number of columns of the tray. The first loading block 32 and the second loading block 42 are therefore formed as panels.

The flaring tool 60 has flaring tips 61. The flaring tips 61 press downwardly onto the open upper ends of the tubes to provide a very slight flare to the upper ends of the tubes and ensure a circular profile in case any top edges are dented or not uniform. The flaring step is completed after the loading step. The first slide plate opening 51 and the second slide plate opening 52 can also be provided in multiples and arranged in rows such that there is a first row of slide plate openings and a second row of slide plate openings. The slide plate openings are preferably smaller than the flared tips of the tubes after forming by the flaring tips 61. Similarly, the first pushing tamper 37 and the second pushing tamper 47 can be formed in multiples and arranged in rows such that there is a first row of pushing tampers and a second row of pushing tampers. The first dropper 36 and the second dropper 46 can be formed in multiples and arranged in rows such that there is a first row of droppers and a second row of droppers. Also, the first loading cup and the second loading cup can be formed as a first row of loading cups and a second row of loading cups. Thus, given the array nature of the loading station, the flaring tool 60 also preferably has flaring tips 61 arranged in an array to provide multiple flaring of multiple tubes in a single batch process.

After the first station, the second station 12 has a mesh roll material 71 that is cut into circular disks for lodging to tube ends. The mesh material is metal and is connected to the tube by press fit. The mesh roll 71 can be provided on a roll such as a roll mounted on a spool. The mesh roll 71 then has punched holes 72 after punching. The punched holes are punched by a suction punch 80.

The suction punch 80 travels between the secondary press mechanism 90 and the roll dispenser 70 on a rail. The roll dispenser 70 incrementally feeds the mesh roll 71 such that new material from the mesh roll is fed to be exposed through a first die slot 73 and a second die slot 72.

The roll dispenser 70 is located laterally from the secondary press mechanism 90. The suction punch 80 has a roll punch position 75 where the suction punch 80 is located over the roll dispenser 70. The mesh roll 71 feeds on a roller 77 underneath the first die slot 73 and the second die slot 74. The punched holes 72 of the consumed material can be retrieved for recycling. The roll dispenser 70 is mounted on a roll dispenser frame 79.

The suction punch 80 travels between the roll punch position 75 and the tray loading position 94. The suction punch 80 has a flexible hose 88 which is kept under suction. The flexible hose 88 feeds to a first suction array 83 which is connected to the first punch array 81 and a second suction array 84 which is connected to a second punch array 82. When mesh material is punched in circular disks, the circular disks of mesh material are suctioned to the first and second punch arrays. The punch arrays then load the tubes with the mesh material inserts. The mesh material inserts are then pressed down using adjustable height rods 91.

The individual tube punches are mounted in rows to produce a first and second punch array. Then, the suction from the flexible hose 88 biases the mesh material inserts against the edges of the tube punches. The suction punch 80 reciprocates upwardly and downwardly on a vertical rail punch guide 85. The suction punch 80 travels downwardly at the press position 76 to deliver the mesh material inserts to the paper tubes mounted on the trays. The suction punch 80 travels downwardly at the roll punch position 75 for punching new material from the mesh roll 71. The suction punch 80 retracts to an upward position when the suction punch 80 is traveling laterally on the horizontal suction punch rail 89.

The tray has a tray press position 95 and a tray loading position 94. The paper tubes receive the mesh material inserts at the tray loading position 94 and the mesh material inserts are pressed into the paper tubes at the tray press position 95. The secondary press mechanism 90 has a secondary press motor 92 that presses the adjustable height rods 91 downwardly onto the tray when the tray is in the tray press position 95. The secondary press mechanism 90 reciprocates vertically on secondary press rails 93. After the adjustable height rods 91 of the secondary press mechanism press the mesh material inserts downwardly from the top of the paper tubes into the paper tubes such that they are at a position interior the paper tubes, the tray retracts to the tray transfer position 96. At the tray transfer position 96, the user can pick up the tray or the tray can be conveyed mechanically such as by conveyor belt to the next station.

Figure 3:
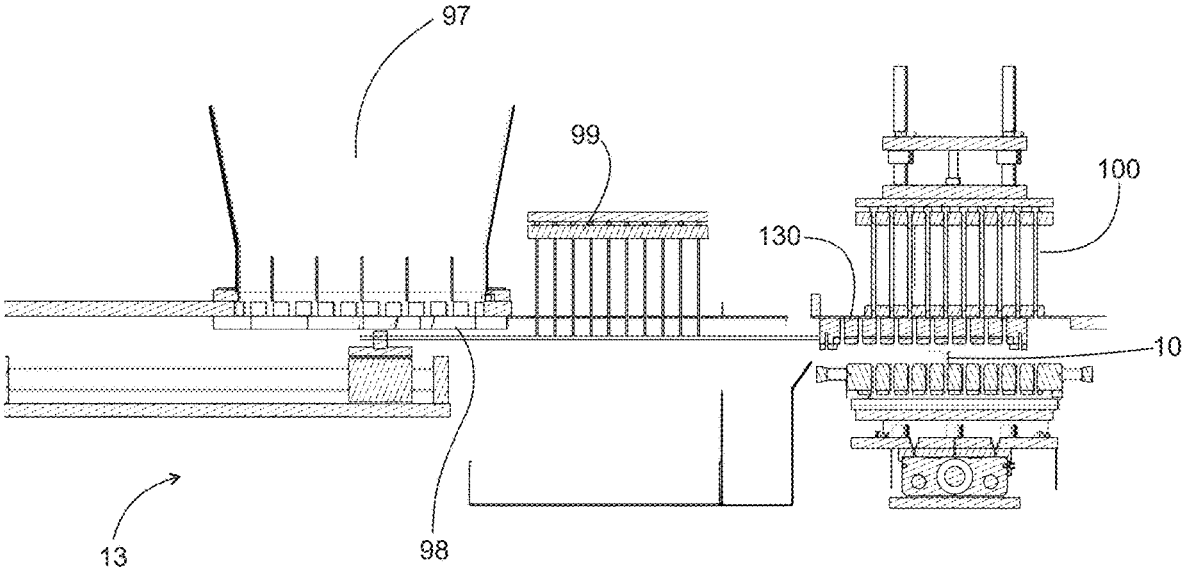
FIG. 3 is a diagram of the third station of the tray loading system showing transfer of plant material and tamping into product tubes.

In the third station 13, as seen in FIG. 3, plant material is packed into the paper tubes and the mesh material retains the plant material within the paper tubes. The third station can have a hopper with a hopper tray and a transfer tray for measuring and then packing plant material into the paper tubes. A hopper 97 receives plant material and transfers it to a measuring tray 98 which moves underneath a transfer tamper 99 that transfers the contents of the measuring tray 98 to the receiving tray 130. Then, the loading tampers 100 press the plant material into the product tubes 10.

Figure 4:
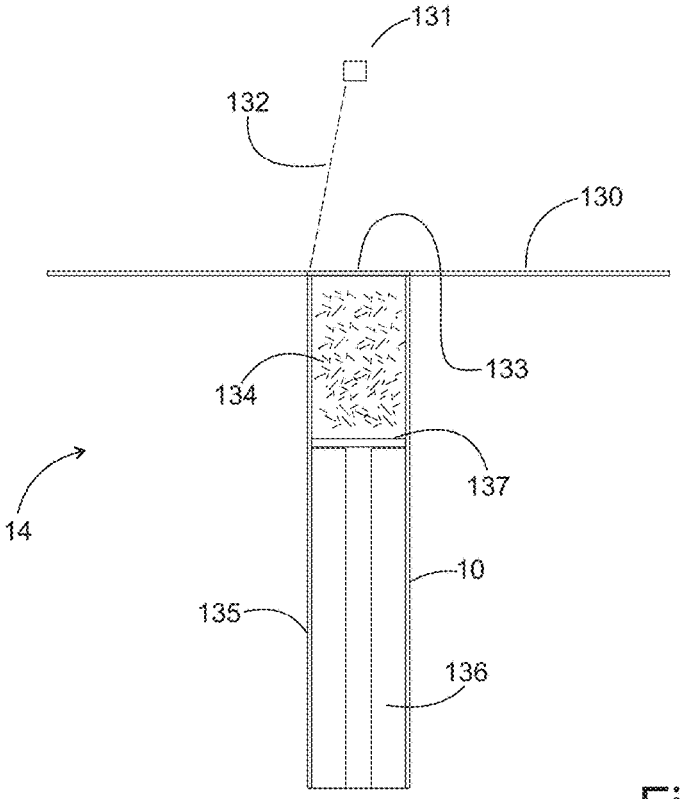
FIG. 4 is a diagram of the fourth station of the tray loading system showing laser cutting of product tube seals.

In the fourth station 14, as seen in FIG. 4, the paper tubes receive a paper seal at an upper edge such that they are finished. The paper layer 130 is placed over the top of the tube sidewall 135 and pasted on. Then, a laser beam 132 from a laser cutter 131 cuts out the paper layer 130 leaving a paper cover 133. The paper cover 133 seals the plant material 134 inside the product tube 10. The mesh disk 137 which was previously pushed into the tube sidewall 135 abuts against the baffle filter 136. The baffle filter 136 can be made of folded paper such as paper that extends from the tube sidewall 135.

Figure 5:
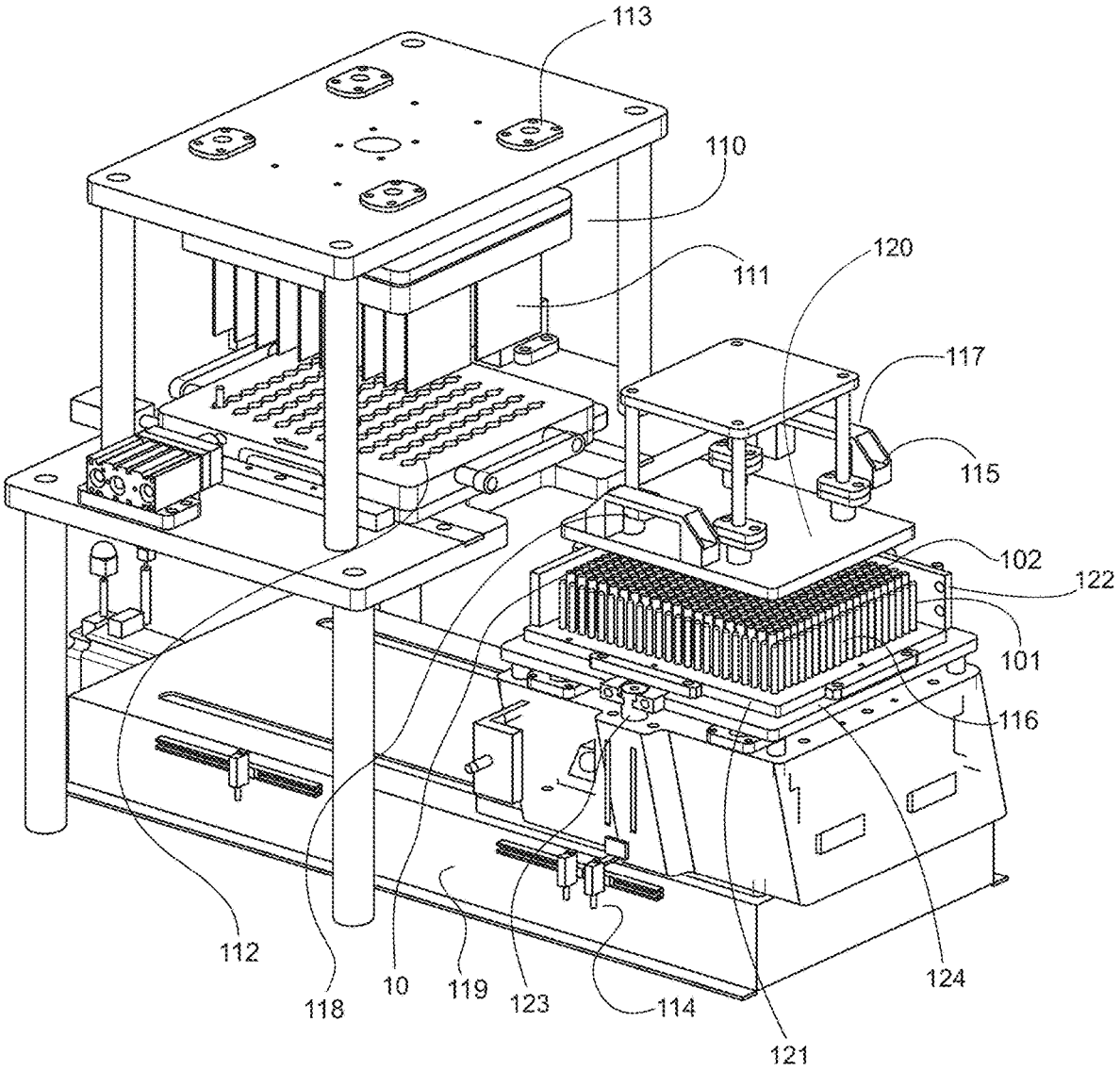
FIG. 5 is a diagram of the fifth station of the tray loading system showing tray unloading and dense packing for transfer to a packaging machine.

In the fifth station, as seen in FIG. 5, the paper tubes are removed from the tray. An ejection mechanism 110 has ejection blades 111 that press downwardly through the tray slots 112. The paper tubes are pushed through tray slots 112 such that they are ejected from the tray. The paper tubes are then pressed into a dense pack 102. The dense pack 102 has retaining fingers 101. The retaining fingers 101 receive the paper tubes. The retaining fingers are mounted in a tube batch transfer container 116. The batch transfer container 116 has servomotor motion such that it moves slightly to receive new product tubes from the trays. The picker rail 119 allows fine motion. The picker rail has picker rail stops 114 that can be fine-tuned and mechanically adjusted so that the picker rail motion limits can be adjusted without turning off the machine. The product tubes collect in the tube batch transfer container 116 in a dense pack 102.

After the dense pack 102 is full, a press picker 115 may pick up all of the tubes. The press picker can be manually operated with a first transfer handle 117 and a second transfer handle 118. The retaining fingers retract downwardly into the tube batch transfer container. Then, the press picker 115 as a press picker receiving face 120. The press picker receiving face presses against the upper ends of the tubes and sandwiches them between the press picker receiving face 120 and the transfer container base 121. The press picker clamps the product tubes and transfers them to a packaging station. The packaging station is station number six and packages the product tubes into a packaged product assembled in cartons and shrink-wrapped.

The press picker receiving face 120 detaches from the transfer sidewalls 122 when the tubes are being loaded onto the transfer container base 121. The transfer alignment pin 123 secures the alignment between the transfer container base 121 and the transfer table 124. The press picker receiving face 120 is spring-loaded and can retract to release the batch of product tubes 10 into a tray rack.

The invention claimed is:

1. A tray loading and unloading system comprising:

a. a first station, wherein the first station comprises a tray mounted to a tray retainer, wherein the tray retainer is mounted to a tray carriage, wherein the tray carriage is configured to slide on a tray retainer rail between a tray retracted position and a tray extended position, wherein the tray starts as an empty tray at the tray retracted position, wherein the tray travels to the tray extended position to receive product tubes at the tray extended position, wherein the tray extended position has a first pushing tamper that pushes product tubes from a first loading cup into the tray, wherein a first loading arm loads product tubes from a first loading tube into the first loading cup; and b. a second station, wherein the second station comprises a suction punch that punches a mesh roll at a first die slot, wherein the first die slot receives a first punch array of the suction punch, wherein the first punch array is connected to the first suction array, wherein the first suction array is connected to a flexible hose, wherein the first punch array is configured to punch and suction a mesh disk from the mesh roll.

2. The tray loading and unloading system of claim 1, further comprising: a flaring tool included at the first station, wherein the flaring tool reciprocates upwardly and downwardly to press on open ends of the product tubes while ensuring a circular form of the product tubes.

3. The tray loading and unloading system of claim 1, wherein the suction punch of the second station further includes a second punch array.

4. The tray loading and unloading system of claim 3, further including a third station that loads plant material into the product tubes.

5. The tray loading and unloading system of claim 4, further including a fourth station that covers the product tube ends with a seal.

6. The tray loading and unloading system of claim 5, further including a fifth station that packs the product tubes into a dense pack for transfer to packaging.

7. The tray loading and unloading system of claim 6, further comprising: a flaring tool included at the first station, wherein the flaring tool reciprocates upwardly and downwardly to press on open ends of the product tubes while ensuring a circular form of the product tubes.

8. The tray loading and unloading system of claim 6, further comprising: a tray extended position with a first pushing tamper that pushes product tubes from a first loading cup into the tray, wherein a first loading arm loads product tubes from a first loading tube into the first loading cup.

9. The tray loading and unloading system of claim 6, wherein the suction punch of the second station further includes a second punch array.

* * * * *